US007024797B2

(12) United States Patent
Bessa

(10) Patent No.: US 7,024,797 B2
(45) Date of Patent: Apr. 11, 2006

(54) HORIZONTALLY EXTENDING HOSE CLEANING AND DRYING APPARATUS

(76) Inventor: Angelo J. Bessa, 1262 Centennial Ave., Camarillo, CA (US) 93010

( * ) Notice: Subject to any disclaimer, the term of this patent is extended or adjusted under 35 U.S.C. 154(b) by 0 days.

(21) Appl. No.: 10/976,600

(22) Filed: Oct. 28, 2004

(65) Prior Publication Data

US 2005/0086829 A1 Apr. 28, 2005

Related U.S. Application Data

(60) Provisional application No. 60/515,384, filed on Oct. 28, 2003.

(51) Int. Cl.
*F26B 7/00* (2006.01)

(52) U.S. Cl. ..... 34/381; 34/384; 34/442; 34/90; 34/103; 34/104; 34/194; 34/237

(58) Field of Classification Search ..... 34/380, 34/381, 385, 442, 90, 103, 104, 192, 194, 34/237; 211/41.3
See application file for complete search history.

(56) References Cited

U.S. PATENT DOCUMENTS

| | | | | |
|---|---|---|---|---|
| 2,936,898 | A * | 5/1960 | Miguez | 211/41.3 |
| 4,862,602 | A * | 9/1989 | Krill | 34/239 |
| 5,027,531 | A * | 7/1991 | Wiens | 34/104 |

* cited by examiner

*Primary Examiner*—S. Gravini
(74) *Attorney, Agent, or Firm*—Aaron T. Borrowman; Kelly Lowry & Kelley, LLP

(57) ABSTRACT

A horizontally extending hose cleaning and drying apparatus includes a plurality of rack sections connected at ends thereof to create an elongated rack having a slope. Each rack section includes an upper plate having apertures or mesh material to allow water to fall therethrough. Legs are detachably connected to each rack section, the shortest legs being attached to a rack section at one end of the rack and the longest legs being attached to a rack section at the opposite end of the rack to create the slope. Preferably, the rack is of a length of at least 50 feet to accommodate fire hoses.

18 Claims, 2 Drawing Sheets

HORIZONTALLY EXTENDING HOSE CLEANING AND DRYING APPARATUS

RELATED APPLICATION

This application claims priority from U.S. Provisional Application Ser. No. 60/515,384, filed Oct. 28, 2003.

BACKGROUND OF THE INVENTION

The present invention is concerned with hoses, such as fire hoses. More particularly, the present invention is concerned with a cleaning and drying apparatus for hoses and which is particularly adapted for cleaning and drying fire hoses.

Hoses are used by many industries, such as agricultural, commercial, and various other purposes. For example, in the agricultural field hoses are often used for irrigation purposes. Hoses are offered in a wide variety of materials, including rubber, rubber-lined cloth, etc. It is not uncommon to have to drain and dry these hoses periodically, sometimes after each use, to prevent the growth of mildew and maintain the strength and integrity of the hose.

This is particularly the case with fire hoses. Fire hoses often have a cloth exterior and a rubber or other similar elastomeric material lines the inner surface. Such hoses are often provided in lengths of fifty feet or more. Due to the very nature of fighting fires, these hoses are usually soaking wet after use and often dirty after being dragged through the street, burning building, or outdoor area where the fire has been fought. To prolong the life of these hoses, they are cleaned and dried after every use to prevent mildew growth, rot, etc.

In the past, such hoses have been cleaned using mild detergents and water in open spaces, such as a back concrete slab area of a fire house, parking lot or the like. In fairly sophisticated fire houses such areas are grooved so that the water and soap suds will drain away from the hose during cleaning. The hoses are then lifted high upon a vertical pole so that they can air out and dry.

However, it has been found that there are certain disadvantages with this technique. First of all, there is an increasing concern of wasting water and polluting the environment. It would be ideal if such water could be reclaimed and the dirt and soap properly disposed of. Moreover, hanging such long and heavy hoses from a vertical pole has been found to present a safety hazard. In fact, OSHA has recently mandated that fire stations discontinue the practice of elevating hoses vertically as they can fall and severely injure the firemen and others in the vicinity.

Accordingly, there is a need for an apparatus for cleaning and drying hoses, and particularly fire hoses. The present invention fulfills these needs and provides other related advantages.

SUMMARY OF THE INVENTION

The present invention resides in a horizontally extending hose cleaning and drying apparatus. The apparatus is particularly suited for the cleaning and drying of fire hoses at fire stations and the like, and provides a viable alternative from the dangerous practice of hanging the long and heavy hoses from a vertical pole.

The apparatus generally comprises a plurality of rack sections which are connected at ends thereof to create an elongated rack having a slope. In a particularly preferred embodiment, each rack section is approximately four feet in width and five feet in length. In order to accommodate fire hoses, ten of the rack sections are connected end to end to form an elongated rack having a length of approximately 50 feet.

Each rack section has an upper plate having a surface with apertures therethrough, or comprised of a mesh material, adapted to allow water from the hose to fall therethrough. A plurality of legs extend downwardly from each section. Preferably, a frame surrounds the upper plate, to which the legs are detachably connected. Each set of legs are of a different height, the shortest legs being disposed at one end of the rack and the longest legs being disposed at the opposite end of the rack so as to create the sloped surface.

In accordance with the present invention, in order to dry a hose a plurality of rack sections are provided. The rack sections are assembled to create a sloped rack by arranging the rack sections end to end and attaching the legs to the upper plates, or frames thereof, such that the pair of legs with the shortest length are disposed at one end of the rack and the pair of legs with the greatest length are disposed on the opposite ends of the rack. One or more hoses are placed on the sloped rack and dried by allowing the water from the hose to pass through the apertured or meshed upper plates.

Other features and advantages of the present invention will become apparent from the following more detailed description, taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 1:
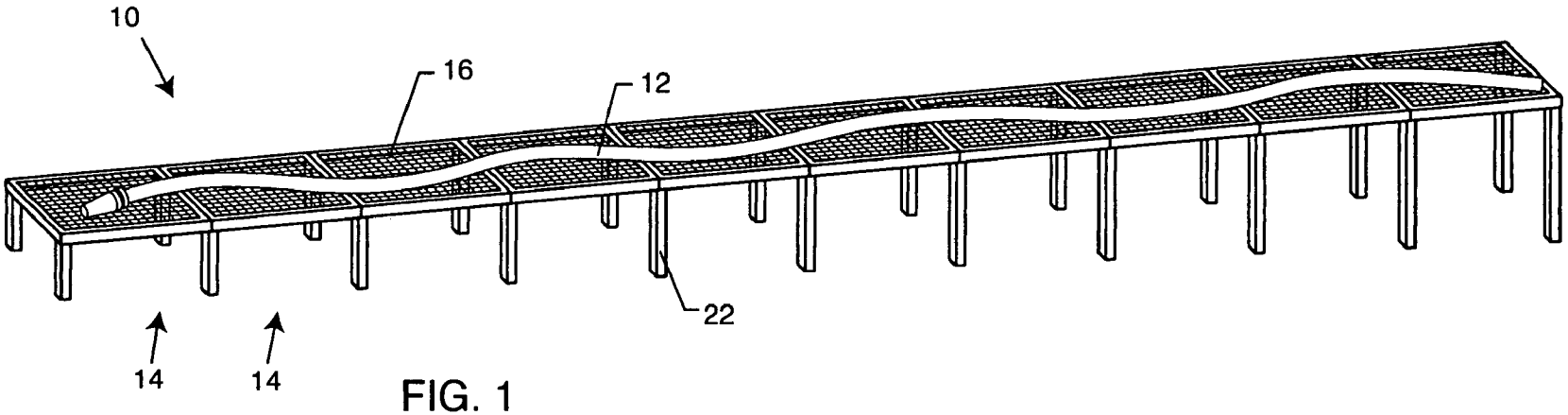
FIG. 1 is a perspective view of a horizontally extending hose cleaning and drying apparatus embodying the present invention, having a fire hose thereon.
Figure 2:
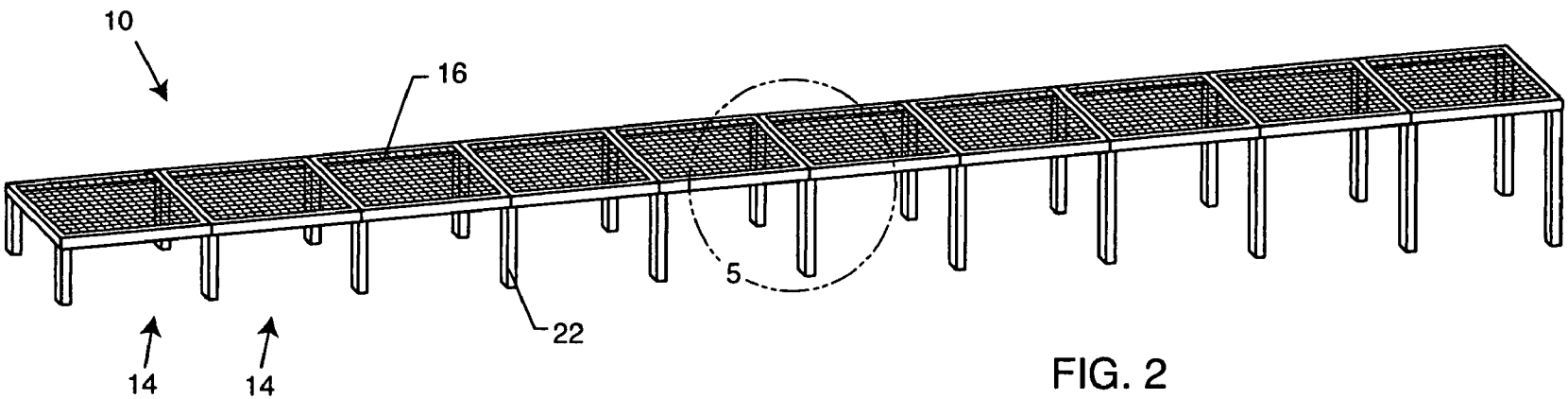
FIG. 2 is a perspective view of the apparatus of FIG. 1, without the fire hose.
Figure 3:
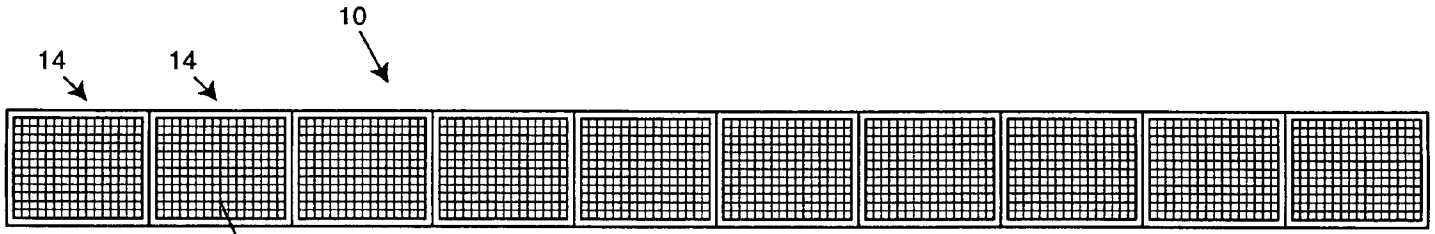
FIG. 3 is a top plan view of the apparatus of FIG. 2, illustrating the multiple adjoined rack sections and appertured upper surface.

As shown in the accompanying drawings for purposes of illustration, the present invention resides in a horizontal extending hose cleaning and drying apparatus, in the form of a rack and generally referred to by the reference number 10. The apparatus 10 is primarily adapted for use with fire hoses 12 of fire stations, but can also be applied to hoses used by the farming industry, cities or counties, or even commercial hoses which require cleaning and drying. As described above, hoses, and particularly fire hoses, must be unrolled, washed, dried and then re-rolled after every instance of use to prolong the life of the fire hose. The present invention facilitates this process while conforming to OSHA standards for safety.

With particular reference now to FIGS. 1–6, the rack apparatus 10 is preferably comprised of a plurality of rack sections 14 which are fastened to one another end-to-end fashion. Each rack section 14 includes an upper surface 16 which is appertured so as to allow water to fall therethrough from the wet hose 12, provide increased air flow around the hose so as to facilitate evaporation and drying and the like. The upper surface 16 may be comprised of a solid sheet of material having apertures drilled or otherwise formed therein, or comprised of a mesh material.

Figure 4:
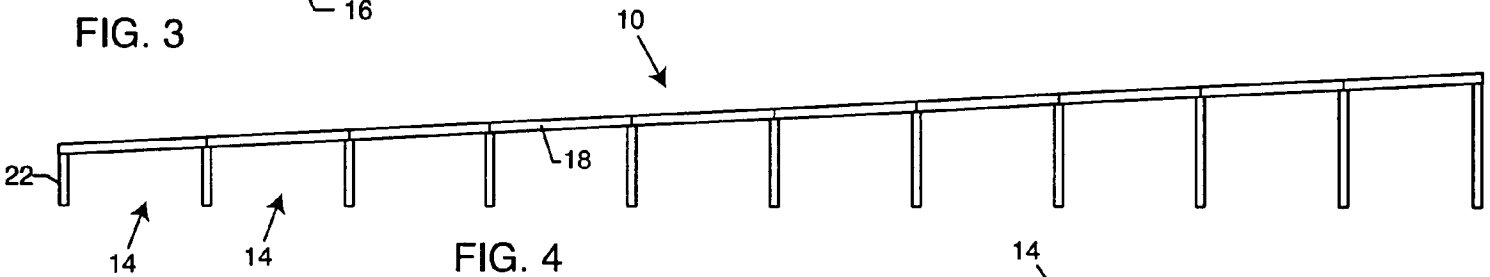
FIG. 4 is a side elevational view of the apparatus of FIG. 2.
Figure 5:
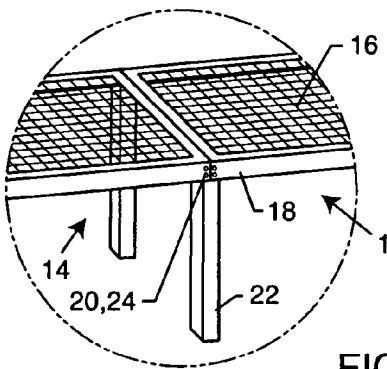
FIG. 5 is an enlarged perspective view of area "5" of FIG. 2, illustrating the connection of two adjoining rack sections and legs.
Figure 6:
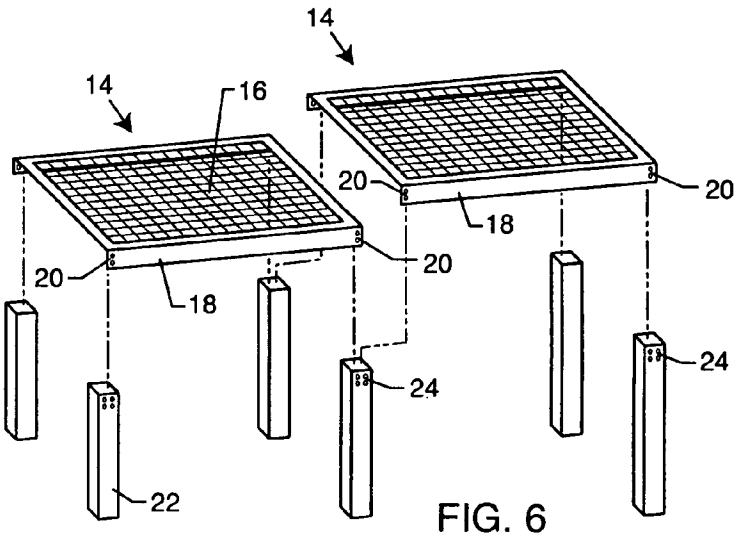
FIG. 6 is an exploded perspective view of two rack sections and a plurality of legs used in accordance with the present invention.

With particular reference now to FIGS. 4–6, in a particularly preferred embodiment, a frame 18 extends downwardly from at least two opposing sides of each upper surface 16. It will be appreciated that the frame 18 can substantial surround the upper plate 16. Each rack section 14, and typically the frame 18 thereof includes apertures 20 for the insertion of screws, bolts or other fasteners so as to interconnect the adjoining rack sections 14.

Each individual rack sections 14 is fastened to at least one pair of legs 22. Typically, as illustrated in FIGS. 5 and 6, the legs include apertures 24 which are alienable with the apertures 20 of the rack sections 14 such that a screw, bolt or the like can be inserted therethrough so as to fasten the legs 22 to the rack sections 14, and also to provide a manner of inner-connecting the rack sections 14 to one another.

With reference now to FIGS. 1, 2, 4 and 6, each pair of legs 22 are of a different length or height. As illustrated in FIG. 4, the shortest pair of legs 22 are attached to an end of the rack 10, and the longest pair of legs 22 are attached to an opposite end of the rack 10. The legs are arranged such that the legs 22 are attached at increasing height along the length of the rack 10 so as to create a sloped surface, as illustrated in FIG. 4.

The individual components (including the rack sections 14, appertured plates frame and legs 22) can be constructed of any durable material such as metal, fiberglass or plastic. The apparatus 10 could be provided as free-standing, solid mounted or as a mobile unit.

The modular design of the present invention enables the apparatus 10 to be shipped in modular form on a pallet making shipping and receiving easy and inexpensive. Moreover, if a rack section 14, leg 22 or any other component becomes damaged, it can be replaced due to the modular nature of the invention.

In a particularly preferred embodiment, the apparatus 10 is used in association with fire hoses. As described above, fire hoses are typically 50 feet in length. Thus, in a particularly preferred embodiment, each rack section 14 is approximately four feet wide and five feet in length. Assembling ten of the rack sections 14 end-to-end, as illustrated in FIGS. 1–4, creates an overall rack 10 having a length of approximately 50 feet. Thus, the rack 10 is able to accommodate hose lengths of 50 feet, or even a hose of 100 feet with the open ends both extended towards the lower end of the apparatus 10. The four foot width enables the placement of multiple hoses 12 thereon, or the looping of hoses such as the 100 foot hose. Providing new rack sections 14 in a four foot by five foot (4'×5') dimension also enables the apparatus 10 to be shipped in a modular form in a four foot by five foot by ten inch (4'×5'×10") pallet. However, it will be appreciated that the individual rack section 14 can be of different dimensions in the overall rack 10 length shortened or lengthened depending upon the need of the end user.

In use, a fire station or end user receives the apparatus 10, such as on a pallet within a container or the like. The individual rack sections 14 are abutted end-to-end and the leg 22 attached in the manner described above such that the shortest legs 22 are disposed at one end of the rack, and the longest legs 22 are disposed at the opposite end of the rack 10 so as to create a generally slopped surface. In a particularly preferred embodiment, the shortest legs are approximately twelve inches long and the longest legs, in the 50 foot rack 10, are approximately 42 inches in length. It has been found that the assembly of a four foot wide by a 50 foot long rack 10 can be done with as few as two people in four hours.

One or more hoses are extended along the length and width of the upper surface of the apparatus 10 so as to lie on the apertured plates 16. The hoses can then be scrubbed clean, rinsed and drained and dried, typically outdoors although possibly within an indoor setting. Due to its sturdy nature, firemen and other workers can stand and walk along the length of the apparatus 10 to clean and manipulate the position of the hoses. Due to its low profile, there is virtually no risk of injury by a hose falling therefrom. Due to the apertured nature of the plates 16, the water can fall freely therethrough and the air can properly circulate around the hose as it dries to facilitate quick drying.

It is contemplated by the present invention that the apparatus 10 be fitted for a water recovery system wherein containers or troughs would capture the water as the hoses are cleaned. The water can then be used at a later time or treated to remove the dirt and detergents.

It will be appreciated by those skilled in the art that the apparatus 10 of the present invention enables fire stations to adhere to the OSHAA newly mandated requirements while also providing a means of safely, conveniently, and quickly washing and drying hoses. Due to the modular nature of the apparatus, it can be shipped and received quite easily. Moreover, if a section becomes damaged it only can be replaced due to the modular nature of the invention. Assembly can be performed by non-trained individuals without the need of special tools. The only requirement is that the fire station or business have a sufficiently large open space in which to assemble the apparatus 10. Although the apparatus 10 is primarily designed to be free standing after assembly, the apparatus 10 could be broken down and stored in a relatively small area for later use.

Although an embodiment has been described in detail for purposes of illustration, various modifications may be made without departing from the scope and spirit of the invention. Accordingly, the invention is not to be limited, except as by the appended claims.

What is claimed:

1. A horizontally extending hose cleaning and drying apparatus, comprising:

a plurality of rack sections connected end to end to create an elongated rack having a slope of sufficient length for supporting a fire hose thereon, each rack section having an upper surface with apertures therethrough or comprised of a mesh material adapted to allow water from the hose to fall therethrough;

wherein a plurality of legs extend downwardly from the rack for engagement with a horizontal surface; and wherein the shortest legs are attached at one end of the rack, and the longest leas are attached to an opposite end of the rack to create the slope.

2. The apparatus of claim 1, wherein each rack section comprises an upper plate having the apertures or mesh material, and a plurality of legs extending downwardly therefrom.

3. The apparatus of claim 2, wherein the legs are detachably connected to the upper plate.

4. The apparatus of claim 2, including a frame surrounding the upper plate, wherein the legs are detachably connected to the frame.

5. The apparatus of claim 2, wherein each rack section is approximately four feet by five feet in dimension.

6. The apparatus of claim 1, wherein the elongated rack has a length of approximately fifty feet.

7. The apparatus of claim 2, wherein the legs of each rack section are of a different height, and wherein the shortest legs are attached to a rack section at one end of the rack, and wherein the longest legs are attached to a rack section at an opposite end of the rack.

8. A horizontally extending hose cleaning and drying apparatus, comprising:

a hose; and a plurality of rack sections connected end to end to create an elongated rack having a slope for supporting the hose thereon;

wherein each rack section includes an upper plate having apertures therethrough or comprised of a mesh material adapted to allow water from the hose to fall therethrough, and a plurality of legs extending downwardly therefrom for engagement with a generally horizontal surface; and wherein the legs of each rack section are of a different height, and wherein the shortest legs are attached to a rack section at one end of the rack, and wherein the longest legs are attached to a rack section at an opposite end of the rack.

9. The apparatus of claim 8, wherein the legs are detachably connected to the upper plate.

10. The apparatus of claim 8, including a frame surrounding the upper plate, wherein the legs are detachably connected to the frame.

11. The apparatus of claim 8, wherein each rack section is approximately four feet by five feet in dimension.

12. The apparatus of claim 11, wherein the hose has a length of between fifty and one hundred feet and the elongated rack has a length of approximately fifty feet.

13. The apparatus of claim 8, wherein the hose comprises a fire hose.

14. A method of drying a hose, comprising the steps of:

providing a plurality of rack sections having an upper apertured or mesh plate and a plurality of pairs of legs of increasing length;

assembling the rack sections to create a sloped rack by arranging the rack sections end to end and attaching the legs to the upper plates such that the pair of legs of shortest length are disposed at one end of the rack and the pair of legs of the greatest length are disposed at an opposite end of the rack; and placing a hose on the slope rack and allowing water from the hose to pass through the apertured or mesh upper plates to dry the hose.

15. The method of claim 14, wherein the upper plate includes a frame extending downwardly therefrom, and wherein the legs are detachably connected to the frame.

16. The method of claim 14, wherein each rack section is approximately four feet by five feet in dimension.

17. The method of claim 14, wherein the hose has a length of between fifty and one hundred feet and the assembled elongated rack has a length of approximately fifty feet.

18. The method of claim 14, wherein the hose comprises a fire hose.

* * * * *

UNITED STATES PATENT AND TRADEMARK OFFICE

CERTIFICATE OF CORRECTION

PATENT NO. : 7,024,797 B2
APPLICATION NO. : 10/976600
DATED : April 11, 2006
INVENTOR(S) : Angelo J. Sessa It is certified that error appears in the above-identified patent and that said Letters Patent is hereby corrected as shown below:

Title page,
Item [12], "Bessa" should read -- Sessa --.

Signed and Sealed this

Twenty-seventh Day of June, 2006

JON W. DUDAS
*Director of the United States Patent and Trademark Office*